US006415451B1

(12) United States Patent
Waller

(10) Patent No.: US 6,415,451 B1
(45) Date of Patent: Jul. 9, 2002

(54) SQUIRTING SWIM MASK

(76) Inventor: Gary Waller, 22424 265th Ave., SE Maple Valley, WA (US) 98038

( * ) Notice: Subject to any disclaimer, the term of this patent is extended or adjusted under 35 U.S.C. 154(b) by 0 days.

(21) Appl. No.: 09/837,442

(22) Filed: Apr. 17, 2001

Related U.S. Application Data

(60) Provisional application No. 60/198,303, filed on Apr. 19, 2000.

(51) Int. Cl.[7] ..... A61F 9/02

(52) U.S. Cl. ..... 2/428; 222/175; 446/27; 446/153

(58) Field of Search ..... 2/428, 452, 438, 2/448, 410, 426; 446/27, 153, 475; 222/175, 78

(56) References Cited

U.S. PATENT DOCUMENTS

| | | | | | |
|---|---|---|---|---|---|
| 2,537,275 | A | | 1/1951 | Malcom, Jr. | |
| 2,971,196 | A | * | 2/1961 | Howell | 2/428 |
| 3,517,393 | A | | 6/1970 | Beauchef | |
| 3,754,298 | A | * | 8/1973 | Menil | 15/250.3 |
| 3,945,044 | A | | 3/1976 | McGee et al. | |
| 4,150,443 | A | | 4/1979 | McNeilly | |
| 4,150,681 | A | * | 4/1979 | Howarth, Jr. | 134/172 |
| 4,505,310 | A | * | 3/1985 | Schneider | 141/114 |
| 4,571,748 | A | | 2/1986 | Carroll et al. | |
| 4,707,863 | A | | 11/1987 | McNeal | |
| 4,868,929 | A | | 9/1989 | Curcio | |
| 4,890,767 | A | * | 1/1990 | Burlison | 222/78 |
| 4,942,629 | A | | 7/1990 | Stadlmann | |
| 5,363,512 | A | | 11/1994 | Grabos, Jr. et al. | |
| 5,370,278 | A | * | 12/1994 | Raynie | 222/175 |
| 5,542,130 | A | | 8/1996 | Grabos, Jr. et al. | |
| 5,947,784 | A | * | 9/1999 | Cullen | 446/15 |
| 5,966,746 | A | | 10/1999 | Reedy et al. | |

* cited by examiner

*Primary Examiner*—Peter Nerbun
*Assistant Examiner*—Katherine Moran
(74) *Attorney, Agent, or Firm*—John D. Gugliotta; P. Jeff Martin

(57) ABSTRACT

A squirting swim mask is provided having a snorkeling mask and a pair of squirt nozzles, one located on either side of the mask, near eye level. Each nozzle connected to squeezable bulbs via sections of thin plastic tubing, with each squeezable bulb having its own one way water valve that allows water to enter the bulb through the valve, but never leave the bulb through the valve.

2 Claims, 3 Drawing Sheets

SQUIRTING SWIM MASK

RELATED APPLICATIONS

The present invention is a continuation of U.S. Provisional Patent No. 60/198,303 filed on Apr. 19, 2000.

BACKGROUND OF THE INVENTION

1. Field of the Invention

The present invention relates generally to scuba masks and, more particularly, to a toy that combines the functions of a scuba mask and a squirt gun.

2. Description of the Related Art

Very few leisure time activities rival that of spending a warm summer day in a swimming pool. Whether it is a large, in-ground, Olympic size pool, a public community pool or a small backyard above ground pool, the relaxation and comfort that is derived from swimming is a healthy benefit for all. Part of the fun associated with these swimming pools are the toys and accessories that go with them. Perhaps the most favorite toy of all is the squirt gun. The latest models of squirt guns hold large amounts of water and squirt for very long distances. But many pools, especially public ones, do not permit such squirt guns from a safety standpoint. Their hard plastic body could cut someone should it accidentally hit someone or become stepped upon. Additionally, the element of surprise is usually gone when someone walks up carrying a squirt gun that is brightly colored and a couple of feet long.

A search of the prior art did not disclose any patents that read directly on the claims of the instant invention; however, the following references were considered related.

U.S. Pat. No. 5,966,746 issued in the name Reedy et al. discloses safety goggles with an active ventilation system.

The following patents disclose goggles and lens with adjustable ventilation:

U.S. Pat. No. 5,542,130 issued in the name Grabos, Jr. et al.; and

U.S. Pat. No. 5,363,512 issued in the name of Grabos, Jr. et al.

U.S. Pat. No. 4,942,629 issued in the name of Stadlmann discloses ski goggles with heated lens.

U.S. Pat. No. 4,868,929 issued in the name of Curcio discloses electrically heated goggles.

U.S. Pat. No. 4,707,863 issued in the name of McNeal discloses an anti-fog goggle with a foam frame.

U.S. Pat. No. 4,571,748 issued in the name of Carroll et al. discloses a frame less goggle and method of making same.

U.S. Pat. No. 4,150,443 issued in the name of McNeilly discloses an anti-fogging sports goggles.

U.S. Pat. No. 3,945,044 issued in the name of McGee et al. discloses a goggle and accessories therefor.

U.S. Pat. No. 3,517,393 issued in the name of Beauchef discloses a pair of goggles with an anti-mist means.

And, U.S. Pat. No. 2,537,275 issued in the name of Malcolm, Jr. discloses a non-fogging goggle.

Consequently, a need has been felt for providing an apparatus and method of improving a toy that combines the functions of a scuba mask and a squirt gun.

SUMMARY OF THE INVENTION

It is therefore an object of the present invention to provide an improved novelty swimmask.

It is a feature of the present invention to provide an improved toy that combines the functions of a scuba mask and a squirt gun.

Briefly described according to one embodiment of the present invention, a toy is provided that combines the functions of a snorkel mask with that of a squirt gun. The outward appearance of the invention is that of a conventional snorkeling mask. However, located on either side of the mask, near eye level, are two squirt nozzles as would be found on a squirt gun. The nozzles are connected to squeezable bulbs via sections of thin plastic tubing. Each squeezable bulb has its own one way water valve that allows water to enter the bulb through the valve, but never leave the bulb through the valve. Thus, when a person is swimming in a pool or other body of water, he or she may approach someone else who is unknowing of the invention. A quick squeeze on the squeezable bulbs below the water line then causes a stream of water to leave the face mask and squirt them. The invention is aimed simply by the user by turning their head.

The use of the present invention allows those playing in a pool or other body of water to enjoy the fun of a squirt gun with unknowing playmates in a safe manner.

The combined functionality of a face mask with a squirt gun allows water to be used directly from a pool such that the toy never needs to be filled.

Additional functionality allows the use of a water tank such that the device can be used outside a pool as well.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DETAILED DESCRIPTION OF THE DRAWINGS

The best mode for carrying out the invention is presented in terms of its preferred embodiment, herein depicted within the Figures.

1. Detailed Description of the Figures

Figure 1:
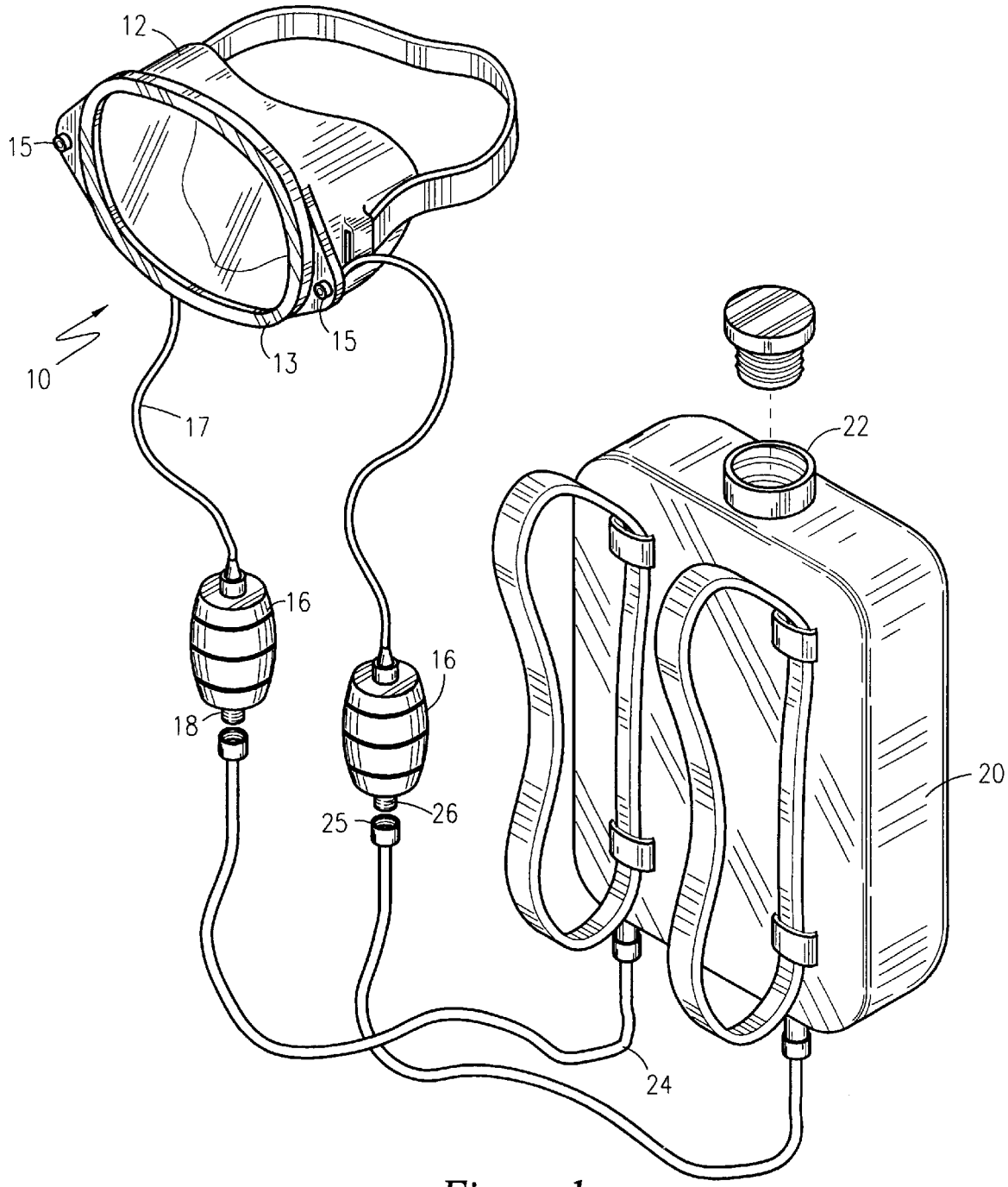
FIG. 1 is a perspective view of a squirting swimmask according to the preferred embodiment of the present invention.
Figure 2:
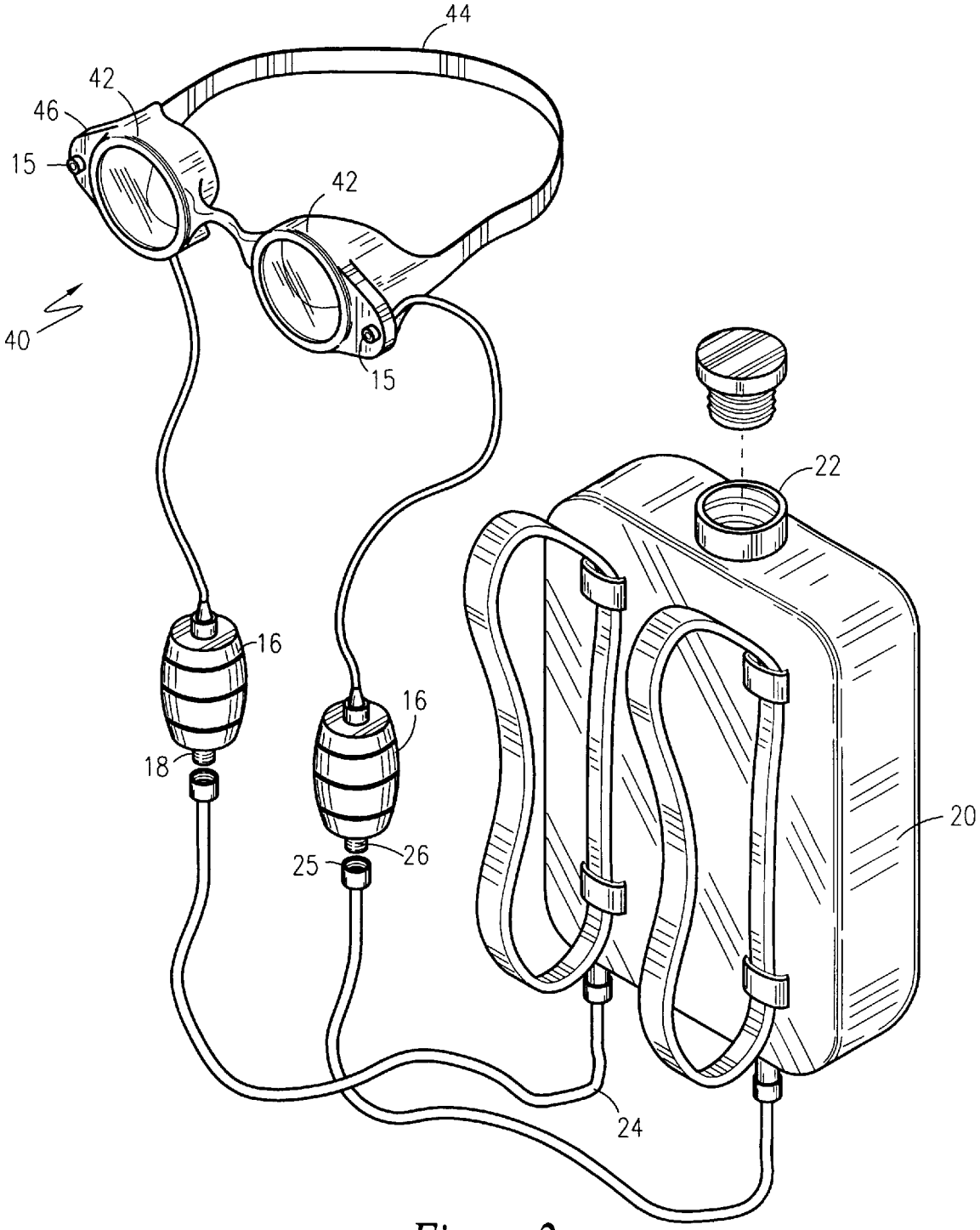
FIG. 2 is a perspective view of a squirting goggles according to the preferred embodiment of the present invention.

Referring now to the FIGS. 1–2, a squirting swim mask 10 is provided as a toy that combines the functions of a snorkel mask 12 with that of a squirt gun. The outward appearance of the invention is that of a conventional snorkeling mask 12. However, located on either side 13 of the mask 12, near eye level, are two squirt nozzles 15 as would be found on a squirt gun. The nozzles 15 are connected to squeezable bulbs 16 via sections of thin plastic tubing 17. Each squeezable bulb 16 has its own one way water valve 18 that allows water to enter the bulb through the valve 18, but never leave the bulb through the valve.

Referring now to FIG. 1, a water tank 20 is shown for use with the squirting swimmask 10. The water tank 20 is accessed by a capped filling nozzle 22, and is in fluid communication with the squeeze bulbs 16 via a second thin plastic tube 24. The second thin plastic tube 24, terminated by a threaded fitting 25, can connect to a threaded receiving nipple 26 that allows access to the bulbs 16 through the one way water valve 18. This allows the use of the present invention to be used outside a pool as well.

Referring now to FIG. 2, a water tank 20 is shown for use with a squirting goggles 40. The goggles 40 include a pair of parallely supported lenses 42 affixed to a user's head by an otherwise conventional headstrap 44. An extension tab 46 extends laterally outward from the side of each lens 42, and supports the squirting nozzle 15. The water tank 20 is accessed by a capped filling nozzle 22, and is in fluid communication with the squeeze bulbs 16 via a second thin plastic tube 24. The second thin plastic tube 24, terminated by a threaded fitting 25, can connect to a threaded receiving nipple 26 that allows access to the bulbs 16 through the one way water valve 18. This allows the use of the present invention to be used outside a pool as well.

Figure 3:
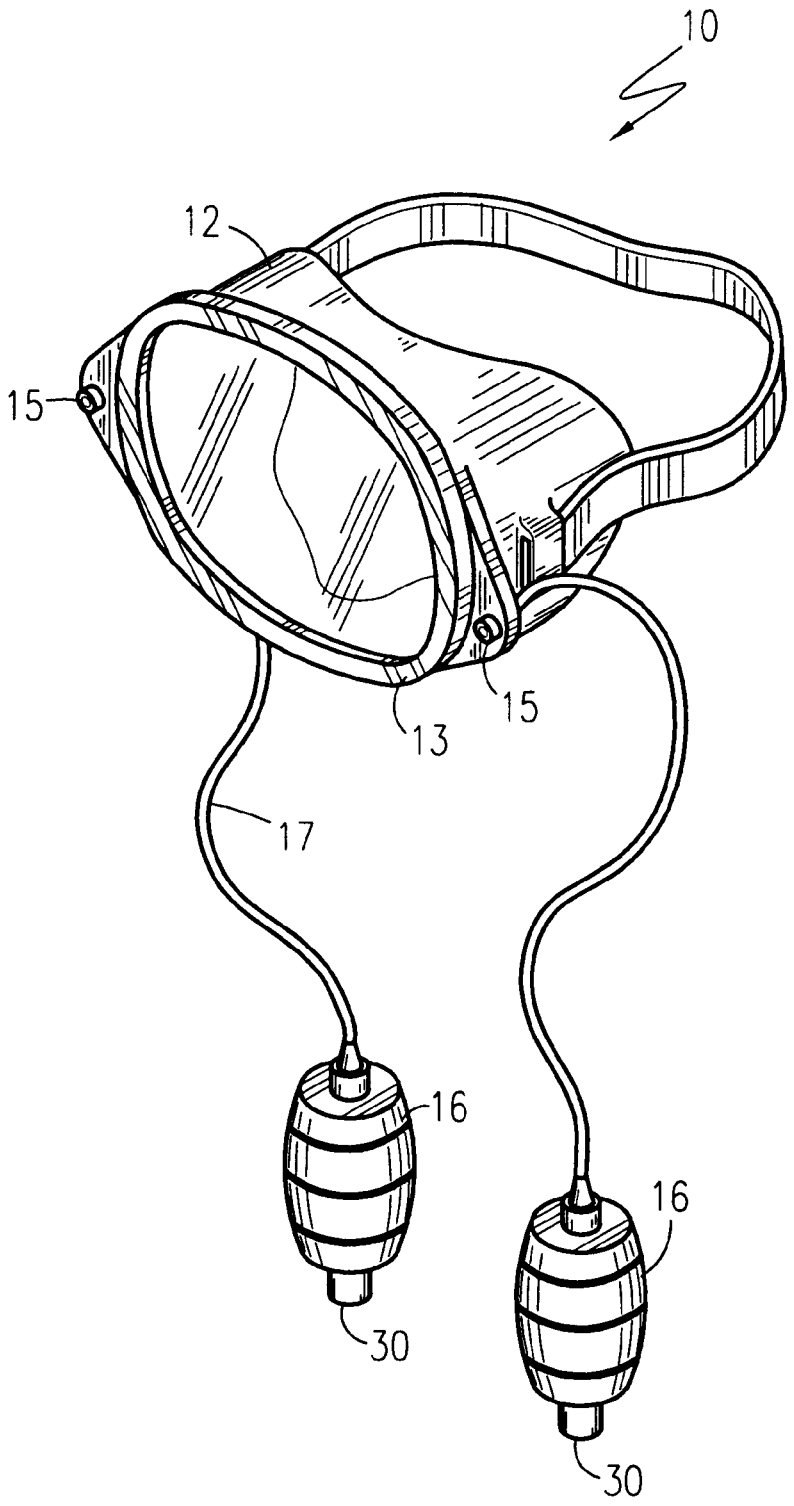
FIG. 3 is a perspective view of a squirting swimmask according to an alternate embodiment of the present invention.

Referring now to FIG. 3, a water inlet orifice 30 is shown having direct access to the bulbs 16, allowing direct fluid communication through the one way water valve 18. This allows the use of the present invention the combined functionality of a face mask with a squirt gun allows water to be used directly from a pool such that the toy never needs to be filled.

2. Operation of the Preferred Embodiment

In operation, the present invention is worn as with an otherwise conventional swimmask or scuba mask. Thus, when a person is swimming in a pool or other body of water, he or she may approach someone else who is unknowing of the invention. A quick squeeze on the squeezable bulbs below the water line then causes a stream of water to leave the face mask and squirt them. The foregoing description is included to illustrate the operation of the preferred embodiment and is not meant to limit the scope of the invention. The scope of the invention is to be limited only by the following claims.

What is claimed is:

1. A squirting swim mask comprising:

a snorkeling mask;

a pair of squirt nozzles, one located on either side of the mask, near eye level, wherein each said nozzle is connected to squeezable bulbs via sections of thin plastic tubing, each squeezable bulb having its own one way water valve that allows water to enter the bulb through the valve, but never leave the bulb through the valve; and a water inlet orifice having direct access to said bulb, thereby allowing direct fluid communication through said one way water valve and allowing the combined functionality of a squirt gun to be used directly from a pool.

2. The squirting swim mask of claim 1, further comprising a water tank in fluid communication with said one way valve, said water tank is accessed by a capped filling nozzle, and wherein said fluid communication between said squeeze bulb and said water tank is via a thin plastic tube.

* * * * *